US005595765A

United States Patent [19]

Christensen et al.

[11] Patent Number: 5,595,765

[45] Date of Patent: Jan. 21, 1997

[54] APPARATUS AND METHOD FOR CONVERTING AXISYMMETRIC GAS FLOW PLENUMS INTO NON-AXISYMMETRIC GAS FLOW PLENUMS

[75] Inventors: Roy W. Christensen, Stockton, Calif.; Steven A. Miller, Amsterdam, N.Y.; David P. Mourer, Beverly, Mass.

[73] Assignee: General Electric Company, Schenectady, N.Y.

[21] Appl. No.: 364,642

[22] Filed: Dec. 27, 1994

[51] Int. Cl.[6] ..... B22F 9/08; C21C 7/00

[52] U.S. Cl. ..... 425/7; 264/12; 266/202; 266/217; 222/603; 222/606

[58] Field of Search ..... 425/6, 7; 264/12; 266/202, 217, 218, 219; 222/594, 603, 606, 607

[56] References Cited

U.S. PATENT DOCUMENTS

| | | | |
|---|---|---|---|
| 4,401,609 | 8/1983 | McGarry et al. | 264/11 |
| 4,485,834 | 12/1984 | Grant | 164/46 |
| 4,619,597 | 10/1986 | Miller | 425/7 |
| 4,631,013 | 12/1986 | Miller | 425/7 |
| 4,801,412 | 1/1989 | Miller | 264/12 |
| 4,946,082 | 8/1990 | Brun et al. | 222/593 |
| 4,966,201 | 10/1990 | Svec et al. | 138/141 |
| 4,978,039 | 12/1990 | Brun et al. | 222/592 |
| 4,993,607 | 2/1991 | Brun et al. | 222/593 X |
| 5,004,629 | 4/1991 | Svec et al. | 427/204 |
| 5,011,049 | 4/1991 | Borom et al. | 222/590 |
| 5,022,150 | 6/1991 | Brun et al. | 29/890.053 |
| 5,048,732 | 9/1991 | Borom et al. | 222/606 |
| 5,244,369 | 9/1993 | Miller et al. | 425/7 |
| 5,289,975 | 3/1994 | Miller et al. | 239/79 |
| 5,310,165 | 5/1994 | Benz et al. | 266/201 |
| 5,325,727 | 7/1994 | Miller et al. | 73/861.61 |
| 5,346,530 | 9/1994 | Miller et al. | 75/331 |
| 5,366,204 | 11/1994 | Gigliotti et al. | 266/202 |

OTHER PUBLICATIONS

"Atomization of Melts for Powder Production and spray Deposition," Andrew J. Yule and John J. Dunkley, Oxford Series on Advanced Manufactering, 1994, pp. 172–179.

*Primary Examiner*—Robert J. Warden
*Assistant Examiner*—E. Leigh Dawson
*Attorney, Agent, or Firm*—William H. Pittman

[57] ABSTRACT

Close-coupled atomization systems and methods employing non-axisymmetric gas flow have demonstrated superior efficiency in the production of fine superalloy powder, compared to conventional close-coupled atomization utilizing an axisymmetric annular gas orifice and an axisymmetric melt nozzle. A means has been devised for convening otherwise axisymmetric plenums into non-axisymmetric plenums that produce non-axisymmetric gas flow.

8 Claims, 8 Drawing Sheets

APPARATUS AND METHOD FOR CONVERTING AXISYMMETRIC GAS FLOW PLENUMS INTO NON-AXISYMMETRIC GAS FLOW PLENUMS

BACKGROUND OF THE INVENTION

The present invention relates generally to closely coupled gas atomization of metals. More particularly, it relates to close-coupled atomization systems and methods of operation of such systems for preparing metal powders which result in increased yields of fine particles. Most particularly, it relates to methods, apparatus and systems for converting axisymmetric fluid flow plenums into non-axisymmetric fluid flow plenums, such as gas or liquids, to result in the efficient atomization of metals, specifically superalloys.

The development of gas atomization nozzles for the production of metallic powders started with remote gas jets, or metal freefall designs, and more recently evolved to close-coupled designs in the quest for greater efficiency and increased yields of fine powder. Many of the early remote jet designs employed a small number of individual gas jets. As the designs matured, the number of jets increased until the limiting case of an annular jet was employed. Almost universally, (see U.S. Pat. No. 4,401,609), the technology moved toward the application of axisymmetric melt and axisymmetric gas flows for fine powder efficiency improvements. The knowledge base regarding axisymmetric melt and axisymmetric gas flows generated with remote gas jets was carried over into the design of early close-coupled nozzle atomization systems. During early efforts to increase fine powder yields, gas plenum designs received much attention in order to ensure a high degree of gas flow symmetry. For a detailed discussion of the history of the atomization of melts, both axisymmetric and asymmetric, see "Atomization of Melts for Powder Production and Spray Deposition," A. J. Yule and J. J. Dunkley, Oxford University Press, 1994, the disclosure of which is hereby incorporated by reference.

Conventional close-coupled atomization system gas nozzles and melt guide tube geometries typically include axisymmetric melt guide tubes with either annular, axisymmetric fluid flow gas nozzle orifices or multiple discreet gas jets. Multiple gas jets presented a relatively simple mechanical and assembly design problem and designs have been proposed which provide acoustic augmentation to the liquid breakup. Although multiple jet designs represented a deviation from purely axisymmetric atomization, there is significant evidence that the individual gas jet streams merged together providing a substantially axisymmetric gas flow prior to contacting the liquid melt stream. Few, if any, non-axisymmetric melt guide tube or gas orifice geometries are believed to have been proposed in order to increase fine particle yields.

While close-coupled or closely coupled metal atomization is a relatively new technology, methods and apparatus for the prior practice of close-coupled atomization are set forth in commonly owned U.S. Pat. Nos. 4,619,597; 4,631,013; 4,801,412; 4,946,082; 4,966,201; 4,978,039; 4,993,607; 5,004,629; 5,011,049; 5,022,150; 5,048,732; 5,244,369; 5,289,975; 5,310,165; 5,325,727; 5,346,530 and 5,366,204 the disclosures of each are incorporated herein by reference. Among other things, these patents disclose the concept of close coupling, i.e., to create a close spatial relationship between the point at which a melt stream emerges from a melt guide tube orifice and a point at which a gas stream emerges from a gas nozzle orifice to impact or intersect the melt stream and interaction therewith to produce an atomization zone.

Because known prior attempts to operate closely coupled atomization apparatus resulted in many failures due to the many problems which were encountered, most of the prior art, other than those mentioned above, for atomization technology concerned remotely coupled apparatus and practices. The technology disclosed by the above referenced patents is believed to be one of the first, if not the first, successful closely coupled atomization systems to be developed that had potential for commercial operation.

For a metal atomization processing system, accordingly, the higher the percentage of the finer particles which are produced the more desirable the properties of the articles formed from such fine powder by conventional powder metallurgical techniques. For these reasons, there is a strong economic incentive to produce higher and higher yields of finer particles through atomization processing.

As pointed out in the commonly owned patents above, the close-coupled atomization technique resulted in the production of powders from metals having high melting points with higher concentration of fine powder. For example, it was pointed out therein that by the remotely coupled technology only about 3% of powder produced industrially is smaller than 10 microns and the cost of such powder is accordingly very high. Fine powders of less than 37 microns in diameter of certain metals are used, for example, in low pressure plasma spray applications. In preparing such fine powders by remotely coupled techniques, as much as about 60% to about 75% of the resulting powder had to be scrapped because it was oversized. The need to selectively separate out and keep only the finer powder and to scrap the oversized powder increases the cost of producing usable fine powder.

Further, the production of fine powder is influenced by the surface tension of the melt from which the fine powder is produced. High surface tension melts increase the difficulty in producing the fine powder and, thus, consume more gas and energy.

A major cost component of fine powder prepared by atomization and useful in industrial applications is the cost of the gas used in the atomization. The gas consumed in producing powder, particularly the inert gas such as, for example, argon, is expensive. Thus, it is economically desirable to be able to produce a higher percentage of fine powder particles using the same amount of gas.

With rare exception, for both close-coupled and remote atomization systems, designers have attempted to maintain an axisymmetric relationship between the melt flow and the gas flow. Most often, this was accomplished by using a circular melt stream surrounded by an annular, circular gas jet or a circular array of individual gas jets. Some linear atomizers have been reported using a long thin rectangular slit for the melt orifice (see U.S. Pat. No. 4,401,609). But even here the gas jet geometry is designed to provide a uniform melt spray pattern along the long axis of the slit. Only one remote atomizing nozzle and one non-axisymmetric close-coupled atomizing nozzle are known to have existed prior to the non-axisymmetric system disclosed herein (see U.S. Pat. Nos. 4,631,013 and 4,485,834).

While the early close-coupled atomization systems increased the yields of fine powder relative to the metal free fall remotely coupled systems, there remains a continuing industrial demand for additional increased yields of ultra fine metal powders, e.g., powders having a particle diameter smaller than 37 microns. Accordingly, there is a need to develop metal atomization systems and methods which can increase the yield of such ultra fine powder and narrow the distribution of particle sizes formed. Any resulting system should economically produce improved fine powder yields while being compatible with at least one and preferably both low and high melt superheat metal processing systems.

SUMMARY OF THE INVENTION

In carrying out the present invention in preferred forms thereof, we provide improved close-coupled atomization systems and methods for metal atomization which include: a constrictor(s), operatively positioned in a gas plenum such that non-axisymmetric gas flow is effectuated for making powders having a particle diameter smaller than 37 microns. Illustrated embodiments of the resulting atomization systems which include non-axisymmetric effects resulting from constrictors positioned in the gas plenum for making powders having a particle diameter smaller than, for example, 37 microns are disclosed herein.

In accordance with one aspect of the present invention there are provided systems and methods for atomizing liquid metals into particles having a diameter smaller than 37 microns, these systems and methods include axisymmetric close-coupled gas nozzles having plenums which include constrictor(s) to obtain circumferential mass flux and momentum flux gradients.

One aspect of the present invention is to provide an atomization system that includes axisymmetric close-coupled gas plenum geometries that are modified to produce non-axisymmetric effects through the use of constrictors therein and methods for atomizing molten metal to form metal powder having an improved yield of fine particles.

A specific example of the present invention includes a close-coupled axisymmetric atomization system for atomizing molten metal comprising: a close coupled nozzle including a plenum having a channel therein for delivering gas; a melt guide tube extending axially through the plenum to an exit orifice, the plenum means including means for supporting the melt delivery tube; and constrictor means, operatively positioned in the plenum, for facilitating the interaction of the delivered gas with the molten melt at a point proximate the melt guide tube exit orifice such that the yield of fine powder was increased by about five (5) to about fifteen (15) percent over the yield achieved without the constrictor means.

Another specific example of the present invention includes apparatus for atomizing liquid metal comprising: a liquid metal supply; a gas nozzle for atomizing a stream of liquid metal from the liquid metal supply in an atomization zone having a plume extending from the nozzle; and constrictor means, operatively positioned in a plenum, for facilitating the interaction of the gas with the liquid metal at a point proximate a melt guide tube exit orifice such that the yield of (–400 mesh) fine powder was increased by about five (5) to about fifteen (15) percent over the yield obtained without the constrictor means.

Still another specific example of the present invention includes a system for the close-coupled atomization of liquid metal in an enclosure, the system comprising: a crucible; a gas nozzle operatively positioned in the enclosure; a melt guide tube operatively connected to the crucible; a plenum, operatively connected to the nozzle and operatively positioned relative the melt guide tube, for providing atomizing gas to the nozzle; an atomization zone including a plume, existing when liquid metal is exiting the melt guide tube and gas is exiting the gas nozzle; and constrictor means, operatively positioned in the plenum, for facilitating the interaction of the gas with the liquid metal at a point proximate the melt guide tube exit orifice such that the yield of (–400 mesh) fine powder was increased by about five (5) to about fifteen (15) percent over the yield obtained without the constriction means.

In another specific embodiment of the present invention, a gas plenum useful for the atomization of molten metals comprising: an outer casing for containing a gas; a gas orifice; and means, operatively positioned inside the outer casing, for limiting the redistribution of the gas within the plenum such that local circumferential variations in the gas exiting the orifice cause the mass flux to vary by more than about ten (10) percent and the momentum flux to vary by more than about five (5) percent, as calculated by making isentropic assumptions about the flow around the perimeter of the gas exit using the measured pressure variations of more than about ten (10) percent within the plenum.

Accordingly, an object of the present invention is to provide atomization systems and atomization methods for providing increased yields of metal powder having a particular diameter of at least 37 microns.

A further object of the present invention is to provide atomization systems and methods which provides improved yields of fine powders and is compatible with both low and high melt superheat metal processing systems.

Other objects and advantages of the invention will be apparent from the following description, the accompanying drawings and the appended claims.

DESCRIPTION OF THE PREFERRED EMBODIMENTS AND METHODS

Figure 1:
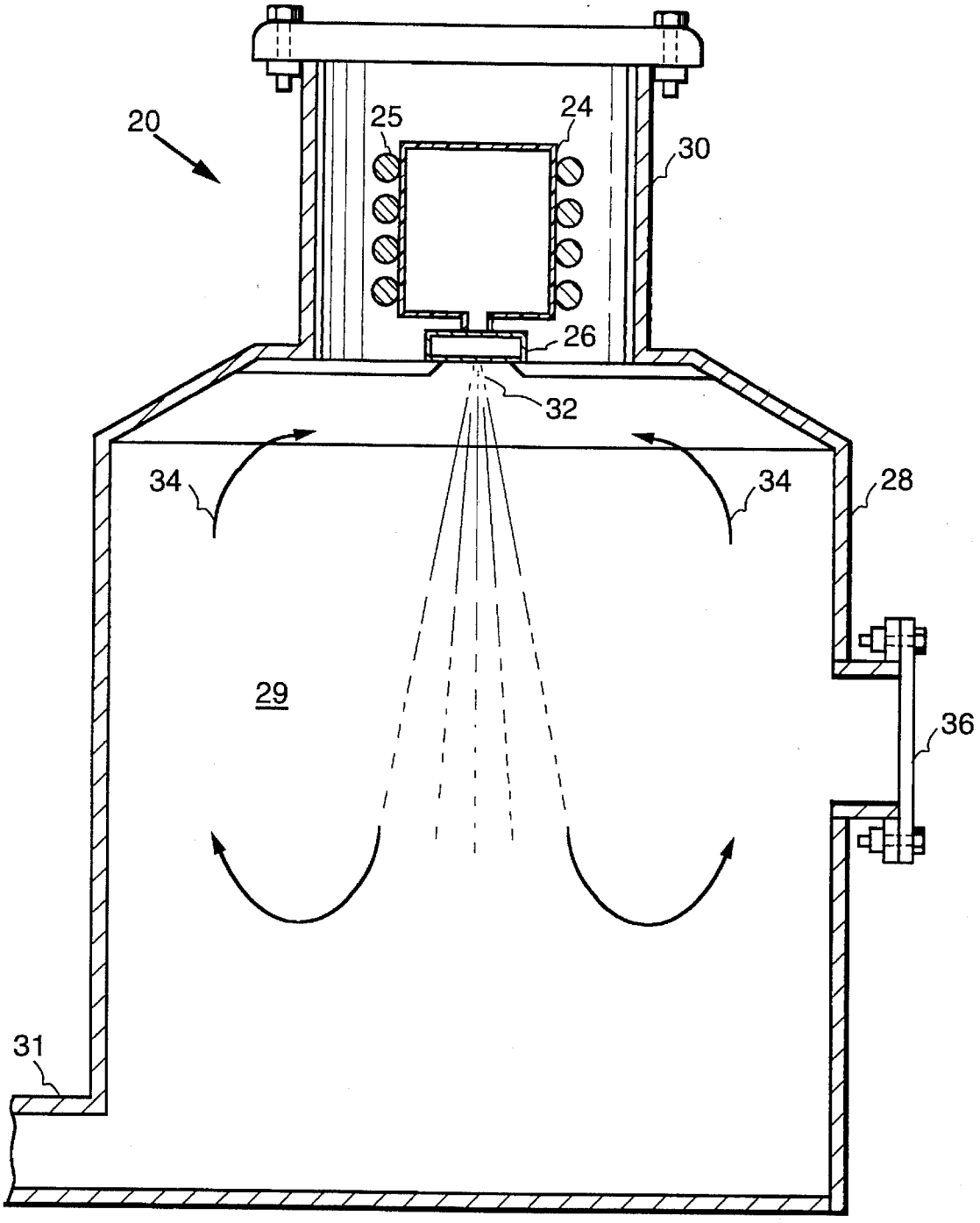
FIG. 1 (PRIOR ART)
FIG. 1 is a schematic side view of a representative atomization system for atomizing molten metal.

Prior to discussing the details of the present invention, two representative prior atomization systems will be described. A representative high melt superheat close-coupled atomization system is illustrated as generally designated by the numeral 20 in FIG. 1. As can be seen, the system 20 comprises a crucible 24, a nozzle 26, which includes a plenum (not shown), and an enclosure 28. The crucible 24 is formed of suitable material for holding the liquid metal, e.g. ceramic such as alumina or zirconia, or water cooled copper. A conventional heating means such as element 25 can be positioned for heating the molten metal therein. The molten metal in crucible 24 can be heated by any suitable means, such as an induction coil, plasma arc melting torch, or a resistance heating coil. The crucible 24 has a bottom pouring orifice coupled with a melt guide tube in nozzle 26. The crucible 24, and nozzle 26 are conventionally mounted on atomization enclosure 28.

The atomization enclosure 28, formed from a suitable material, such as, for example, steel is configured to provide an inner chamber 29 suitable for containing the atomization process. Depending upon the metal being atomized, enclosure 28 can contain an inert atmosphere or vacuum. A suitable crucible enclosure 30 can be formed over the crucible 24 to contain an inert atmosphere for the liquid metal. A conventional vacuum pump system, not shown, or gas supply means, not shown, are coupled with atomization enclosure 28 and crucible enclosure 30 to provide the inert atmosphere or vacuum therein. A conventional exhaust system, not shown, for example with cyclone separators, is coupled with enclosure 28 at connection 31 to remove the atomized powder during the atomization process.

A stream of liquid metal from crucible 24 is atomized by the nozzle 26, forming a plume of molten metal droplets 32 which are rapidly quenched to form solid particulates of the metal. Prior Art close-coupled nozzles are shown, for example, in U.S. Pat. Nos. 4,801,412, 4,780,130, 4,778,516, 4,631,013, and 4,619,845. The nozzle 26 directs a stream of liquid metal into a converging supersonic jet of atomizing gas. The high kinetic energy of the supersonic atomizing gas breaks up the stream of liquid metal into atomized droplets which are widely dispersed in the atomization enclosure. As a result, within several seconds of the initiation of atomization, the atomization vessel is filled with a cloud of recirculating powder particulates, for example shown by arrows 34. While atomization of the liquid metal stream can be viewed at the initiation of atomization, for example from view port 36 mounted on atomization enclosure 28, the interaction between the atomizing gas jet and the liquid metal stream is obscured by the cloud of metal particulates within a few seconds.

Figure 2:
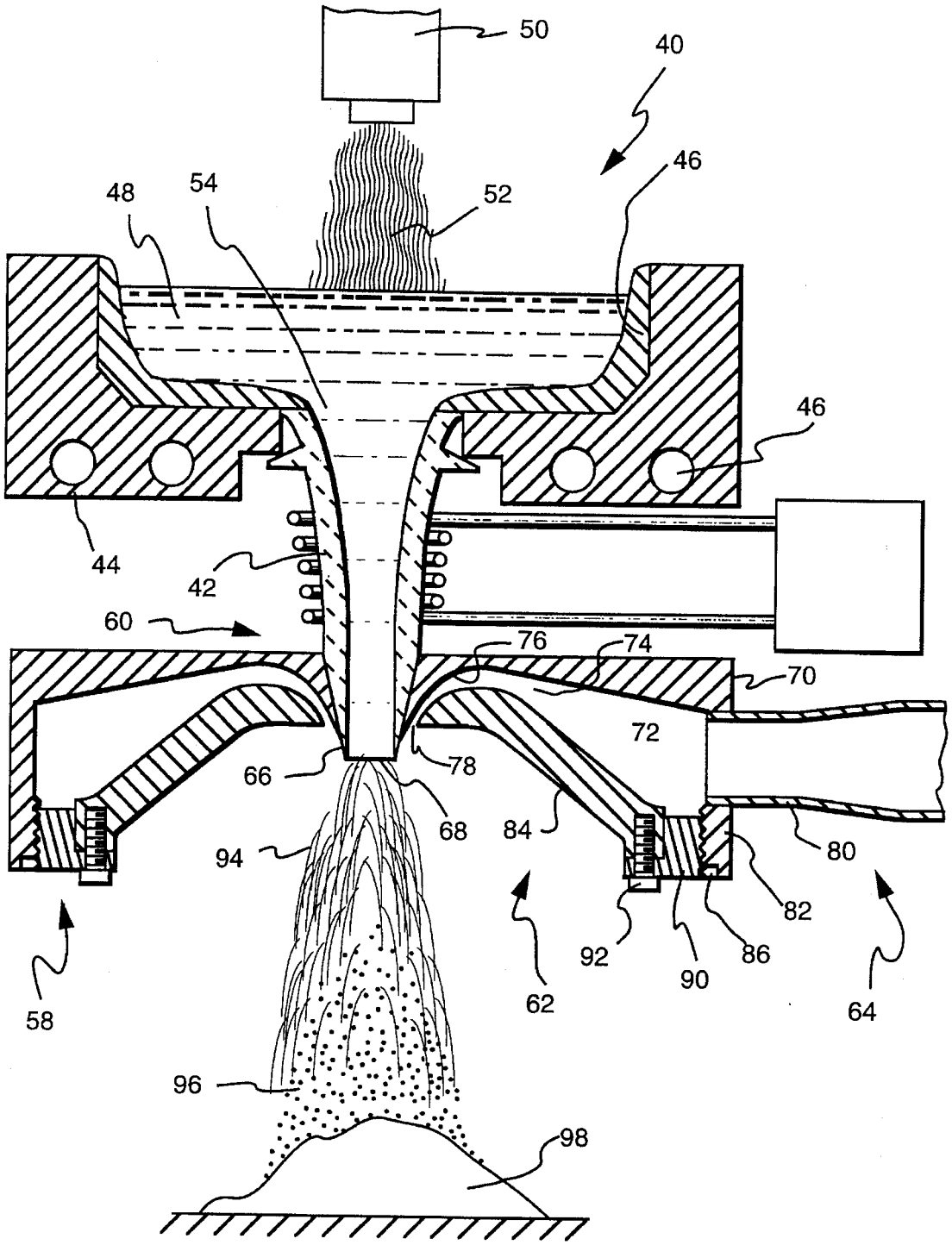
Fig. 2 (PRIOR ART)
FIG. 2 is a sectional view of a cold hearth apparatus operatively linked to an induction heated melt guide tube and to a shallow close-coupled nozzle atomization apparatus.

FIG. 2 illustrates a representative close-coupled atomization system compatible with low melt superheat metal processing. The system, as illustrated, is described in commonly assigned U.S. Pat. No. 5,366,204 issued Nov. 22, 1994.

As described therein, a melt supply reservoir and a melt guide tube are shown semischematically. The melt is supplied from a cold hearth apparatus 40 which is illustrated undersize relative to a melt guide tube 42. The cold hearth apparatus includes a copper hearth or container 44 having water cooling passages 46 formed therein. The water cooling of the copper container 44 causes the formation of a skull 46 of frozen metal on the surface of the container 44, thus, protecting the copper container 44 from the action of the liquid metal 48 in contact with the skull 46. A heat source 50, which may be, for example, a plasma gun heat source, having a plasma flame 52 directed against the upper surface of the liquid metal of molten bath 48, is disposed above the surface of the cold hearth apparatus 40. The liquid metal 48 emerges from the 30 cold hearth apparatus through a bottom opening 54 formed in the bottom portion of the copper container 44 of the cold hearth apparatus 40. Immediately beneath the opening 54 from the cold hearth, a melt guide tube 42 is disposed to receive melt descending from the reservoir of metal 48. The tube 42 is illustrated oversize relative to hearth 40 for clarity of illustration.

The melt guide tube 42 is positioned immediately beneath the copper container 44 and is maintained in contact therewith by mechanical means, not shown, to prevent spillage of molten metal emerging from the reservoir of molten metal 48 within the cold hearth apparatus 40. The melt guide tube 42 may be, for example, a ceramic structure or any structure which is resistant to attack by the molten metal 48. Melt guide tube 42 may be formed of, for example, boron nitride, aluminum oxide, zirconium oxide, or any other suitable ceramic material or other suitable material compatible with the metal atomization process. The molten metal flows down through the melt guide tube to the lower portion thereof from which it can emerge as a stream into an atomization zone.

Melt passes down through the melt guide tube and is atomized by a close-coupled atomization apparatus 58 which is more fully described in copending applications Ser. No. 07/920,075, filed Jul. 27, 1992, abandoned, and Ser. No. 07/920,066, filed Jul. 27, 1992, abandoned, the disclosures of each are herein incorporated by reference.

As shown, there are three structural elements in the atomization structure of FIG. 2, The first is a central melt guide tube structure 60. The second is the gas atomization structure 62, and the third is the gas supply structure 64. The melt supply structure 60 is essentially the lower portion of the melt guide tube structure 42. The melt guide tube is a structure which ends in an inwardly tapered lower end 66, terminating in a axisymmetric melt orifice 68. The axisymmetric gas atomization structure 62 includes a generally low profile housing 70 which houses a plenum 72 positioned laterally at a substantial distance from the melt guide tube 42. The atomizing gas from plenum 72 passes generally inwardly and upwardly through a narrowing neck passageway 74 into contact with a gas shield portion 76 where the gas is deflected inward and downward to the orifice 78 and from there into contact with melt emerging from the melt orifice 68.

The plenum 72 is supplied with gas from a gas supply, not shown, through the gas supply structure 64, such as a pipe. Pipe 64 has necked down portion 80 where it is attached to the wall 82 of the housing 70. The lower portion of plenum 72 is a shaped adjustable annular structure 84 having a threaded outer ring portion 86 by which threaded vertical movement is accomplished. Such movement is accomplished by turning the annular structure 84 to raise or lower it by means of the threads at the rim of ring 86 thereof. A ring structure 90 is mounted to annular structure 84 by conventional means such as bolt 92.

The gas atomized plume 94 of molten metal passes down to a region where the molten droplets solidify into particles 96 and the particles may accumulate in a pile 98 in a receiving container.

It has also been found that the systems and methods of the present invention provide an improved yield of fine particles during atomization as compared to the yields realized from the above described systems or the remotely coupled systems. For example, utilizing systems of the present invention, a nickel based superalloy powder having a particle size of about 37 microns or less can be formed with a yield of up to about fifty (50) percent to about sixty five (65) percent as compared to yields of up to about thirty five (35) percent to about forty five (45) percent fine yields obtained from relatively inefficient close-coupled axisymmetric systems.

Initial work with non-axisymmetric gas flows stemmed from actual test experience which resulted in fine powder yield differences between nominally identical axisymmetric melt guide tube and gas orifice geometries, where the sole difference was in the details of the gas supply to the inlet plenum (inlet pipe diameter, number of pipes, proximity to gas orifice etc.).

Measurements of the gas flow exiting the nozzle consistently produced circumferential variations related to the inlet jet locations; minimum pressures occurred in the same plane as the jets and higher pressures in the plane perpendicular to the jets (or opposite for single inlet plenums). The circumferential pressure differences were reduced by inlet jet dynamic pressure reductions purposely accomplished through the use of larger plenum inlets. (Table 1).

This effect can be accomplished by using a non-ideal or small plenum design. The purpose of a plenum is to redistribute gas flow entering the plenum from specific location so that the gas flow exiting the plenum is uniform and does not vary with respect to the position of the exit in the gas plenum. When using a less effective or small plenum the effect of the gas delivery points can be mitigated but are not fully eliminated. The effect is to produce a converging annular flow that varies in mass and momentum flux circumferentially around the gas exit of the plenum. We have shown that, if this variation is in excess of the values shown in FIGS. 10 and 11, it can be used to increase the effectiveness of the atomization process.

TABLE 1

Effect of Plenum Inlet Jets on Circumferential Pressure Uniformity (ii)

| Gas jet Inlet area $in^2$ | Number of inlets | Maximum jet dynamic pressure (calculated) PSI | Max. circumferential pressure difference measured at cone tap PSI |
|---|---|---|---|
| 0.11 | 1 | 30.2 | 11 |
| 0.30 | 1 | 3.9 | 9.5 |
| 0.22 | 2 | 7.6 | 3 |

These measurements demonstrated that there is a measurable effect on gas flow in the atomization region due to plenum inlet variations.

Specifically, when fluid dynamic experts were consulted concerning increasing the yields of fine powder for close-coupled atomization systems, such as those described above, they recommended significantly increasing the volume of the gas plenum. This recommendation was based upon the understanding that increasing the yields of fine powder was directly related to the degree of axisymmetric gas flow that was delivered from the gas plenum to the atomization zone. In other words, it was thought that the yields of fine powder were directly related to the degree of axisymmetric gas flow that was delivered to the atomization zone. A plenum which delivered a pure (100%) axisymmetric gas flow to the atomization zone would produce the highest yields of fine powder. Since, in their opinion, the relatively small volume plenum of the initial close-coupled nozzle designs had considerable room for improvement with regard to more closely approaching pure axisymmetric gas flow, it was decided that the gas plenum volume should be increased to ensure that there were little, if any, pressure gradient differences between different locations around the nozzle orifice. It was thought that such a uniform situation would surely result in higher yields of fine powder and most likely the highest yields of fine powder possible.

Figure 3:
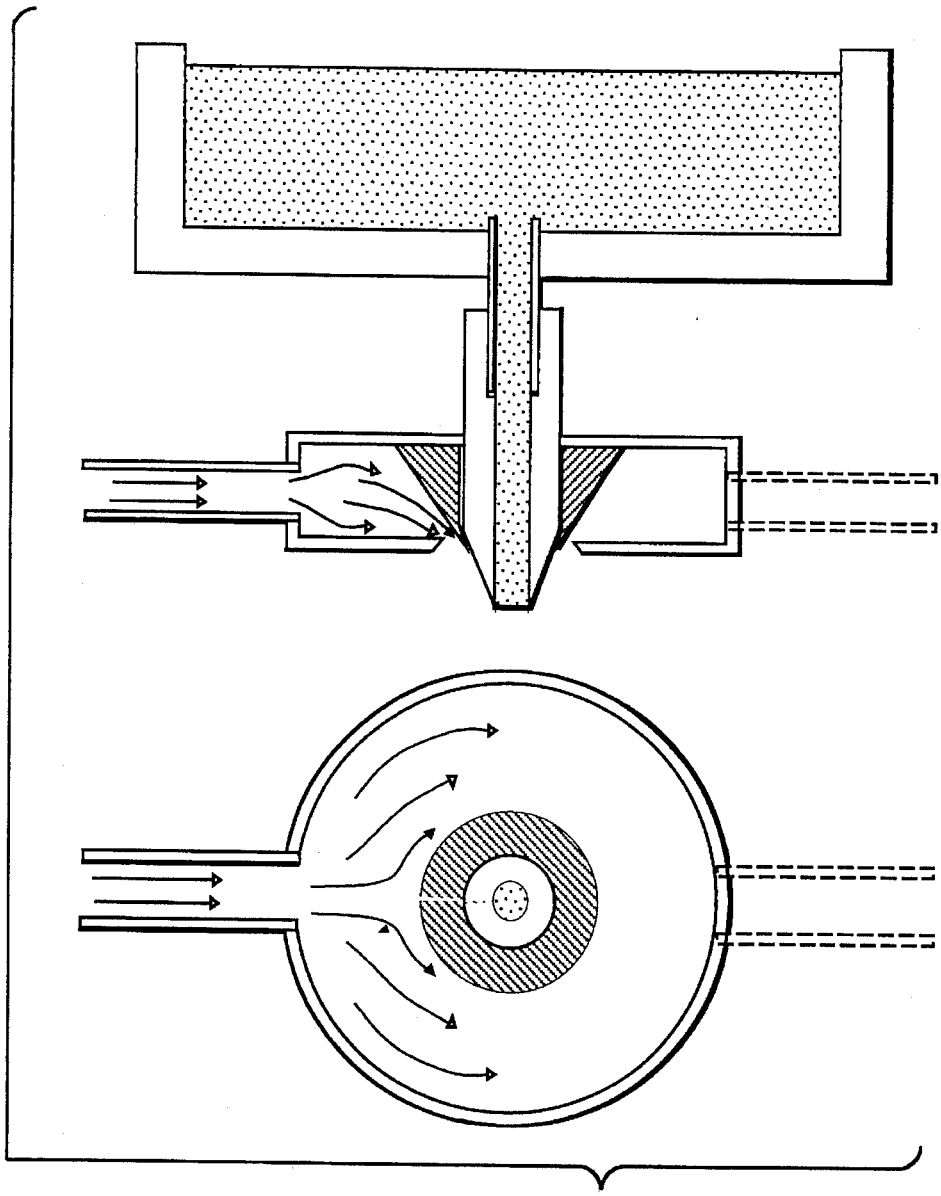
FIG. 3 (PRIOR ART)
FIG. 3 is a sectional representation of a typical small plenum configuration.
Figure 6:
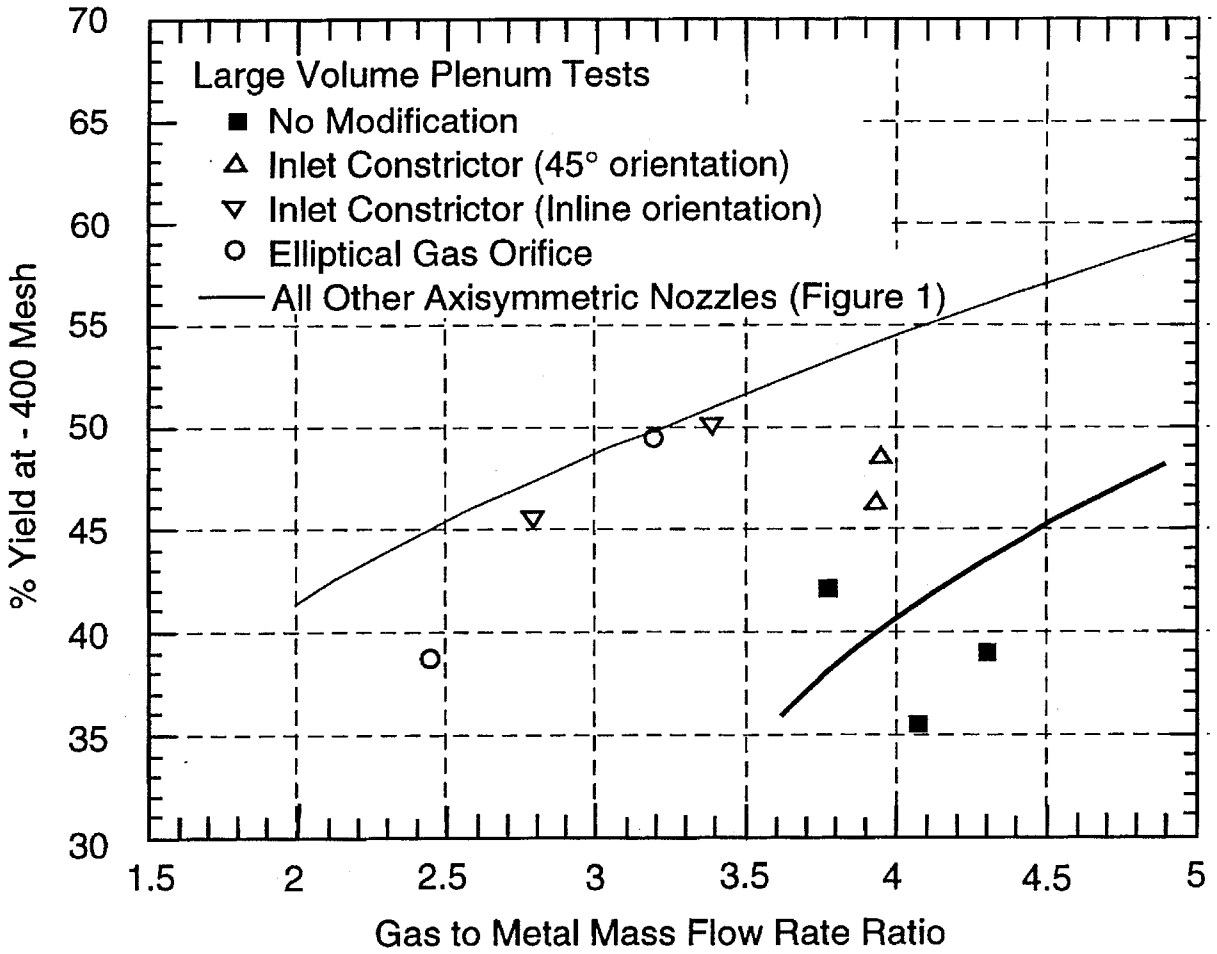
FIG. 6 is a graphical representation of the increased powder yield through use of the constrictors of FIG. 5.

As illustrated in FIG. 6, a new and larger plenum was designed, in part, to further reduce the variations due to the effect of the dynamic pressure of the inlet jets, incorporating gas inlets with a 270% increase in cross sectional area, and provided a larger plenum volume with a more convoluted path to encourage more uniform gas pressure distribution at the gas orifices compared to the plenum configuration of FIG. 3.

This larger plenum configuration was not tested in the above fashion, but had very low calculated inlet jet dynamic pressures. However, when used for melt atomization, this plenum (with an apparently improved and more uniform gas flow) surprisingly produced distinctly inferior powder yields utilizing identical melt nozzles and operating parameters as previously used plenum of FIG. 3.

Figure 4:
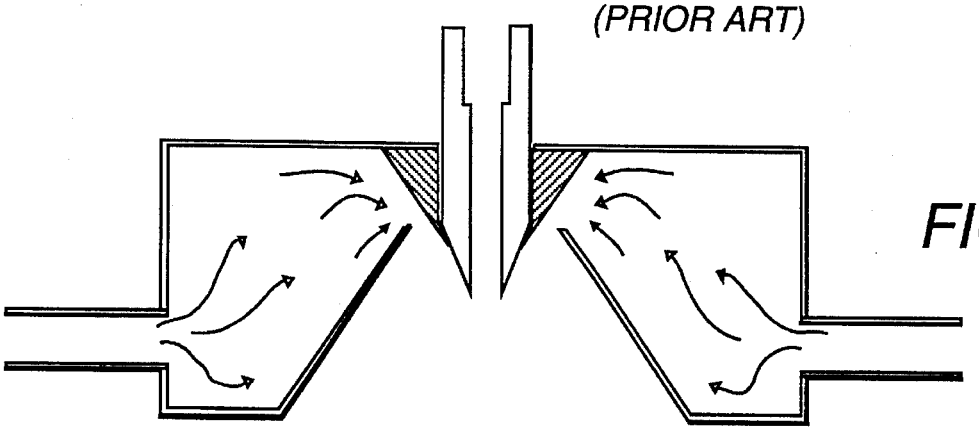
FIG. 4 is a cross section of a larger volume plenum.
Figure 5:
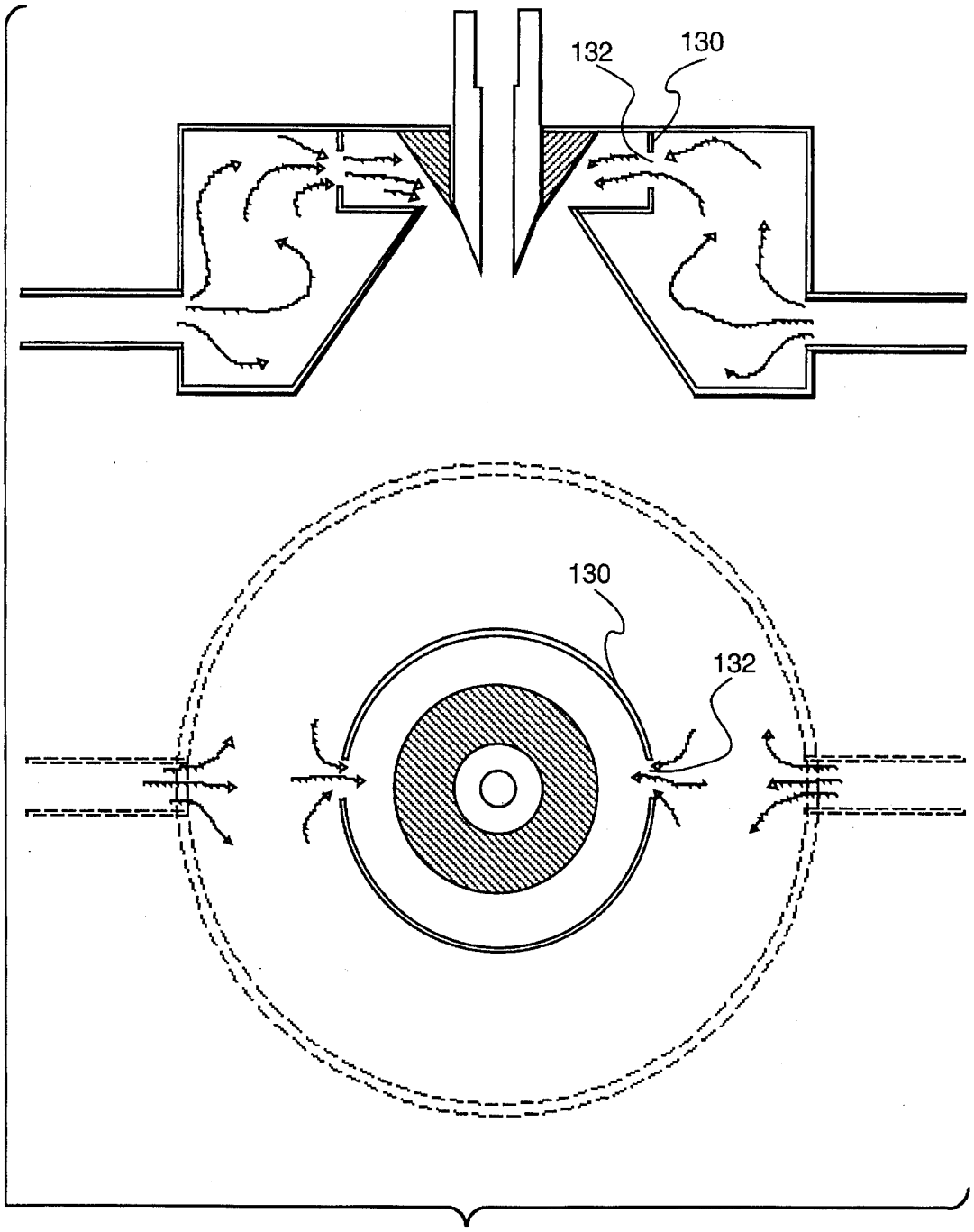
FIG. 5 is a sectional and top view of the plenum of FIG. 4 with flow constrictors positioned to mimic the plenum cross sectional area gas inlets of FIG. 3.

To reproduce the original gas flow (FIG. 3), interior plenum structures, flow constrictors 130, as illustrated in FIG. 5, were introduced into the larger plenum of FIG. 4 so that the gas, in close proximity to the annular orifice, was forced to pass through slots 132 whose total cross sectional area was the same as the original small plenum's gas inlets cross sectional area. Use of the constrictor increased the jet dynamic pressure between the constrictor inlet and the nozzle outlet to the original levels and increased powder yields to their historic values, as shown in FIG. 6.

Figure 7:
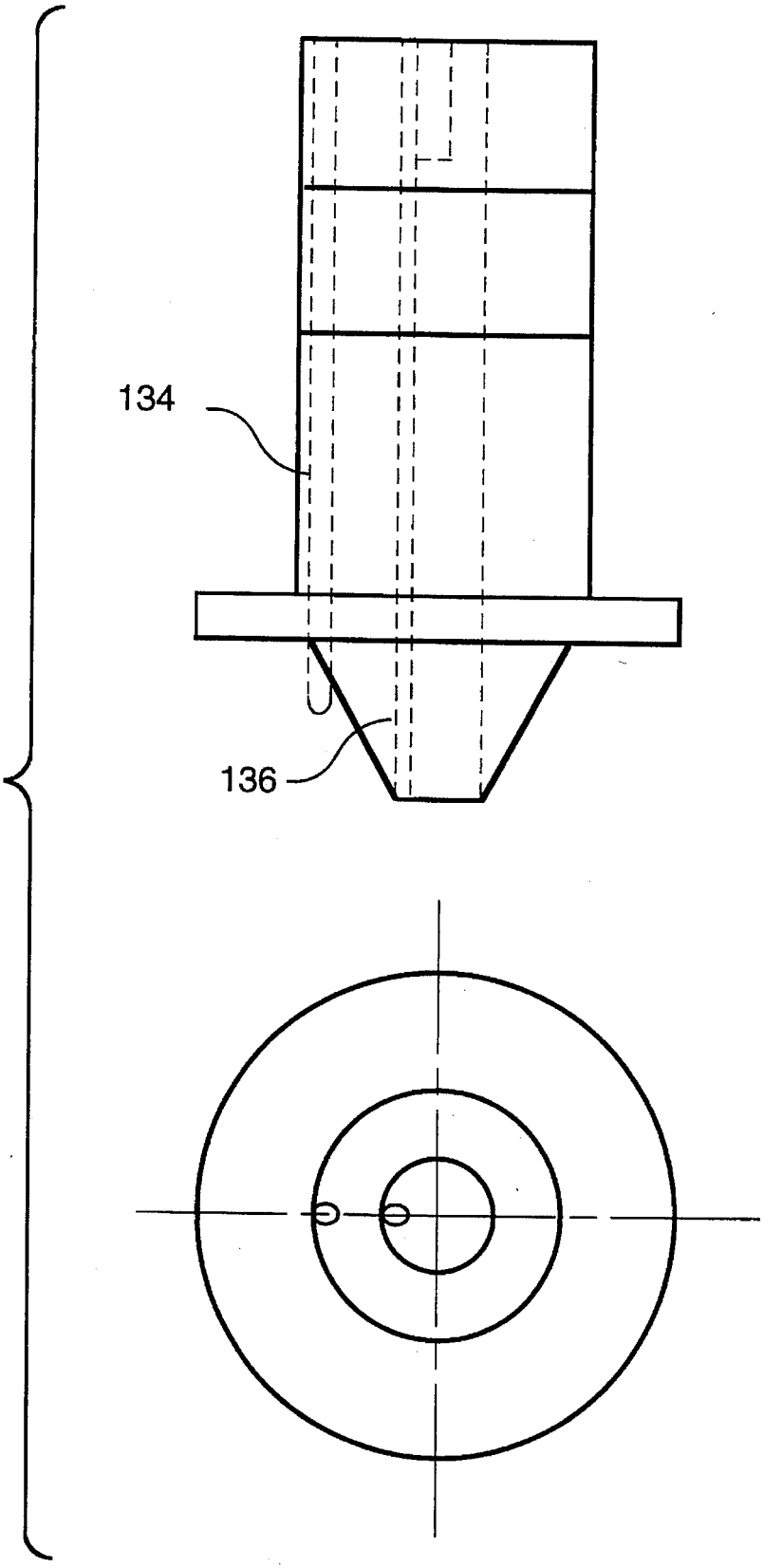
FIG. 7 is a side and bottom view of a simulated nozzle assembly constructed with the local plenum pressure tap and a local aspiration pressure tap.
Figure 8:
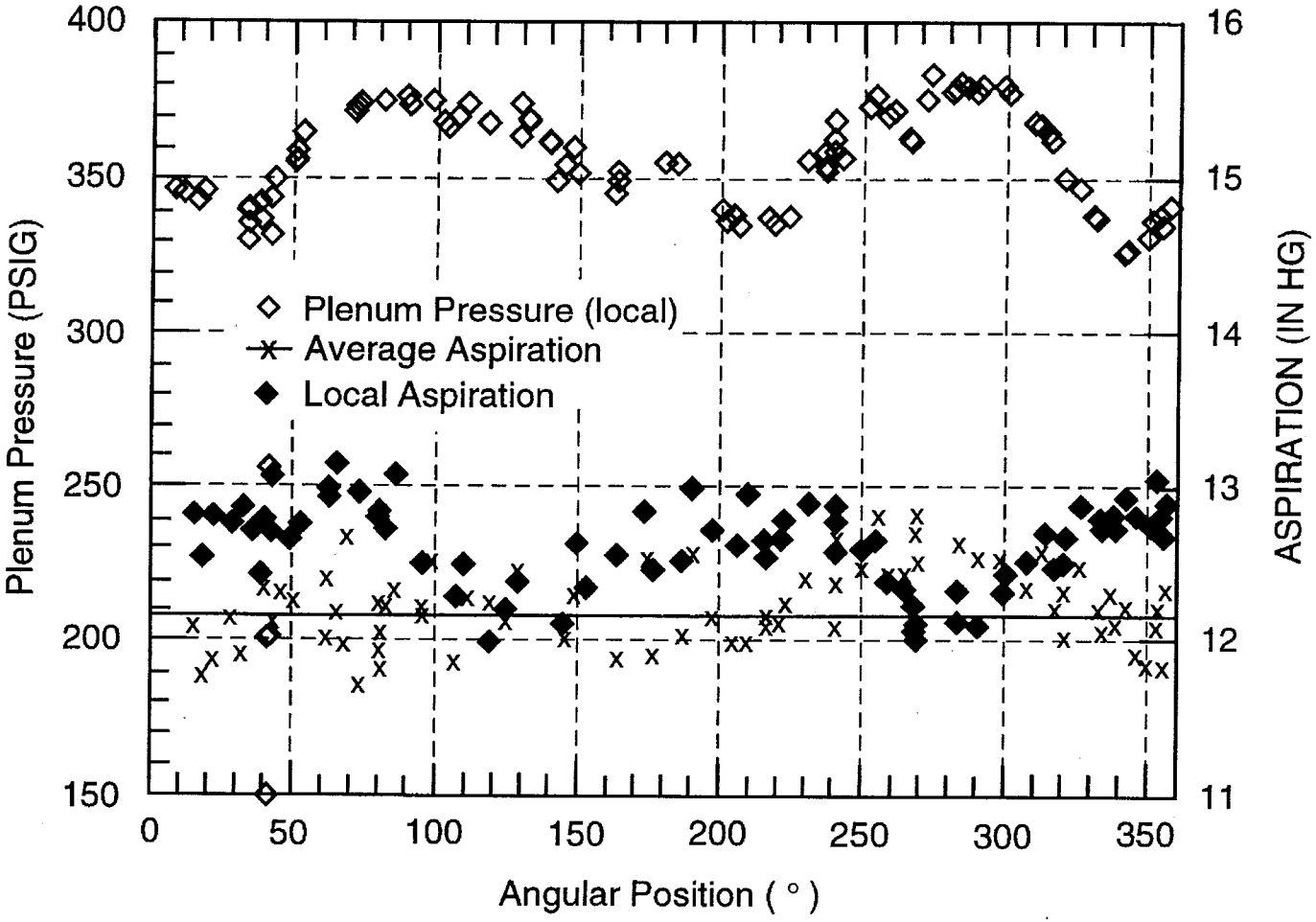
FIG. 8 is a graph which shows the result of the rotation of the assembly of FIG. 7 to provide for circumferential variation in local total pressure and any effect on local aspiration pressure.

These results prompted additional direct measurements of the circumferential variation in total pressure inside the plenum. A simulated nozzle assembly was constructed with a local plenum pressure tap 134 and a local aspiration pressure tap 136, FIG. 7. The assembly could be rotated to provide the circumferential variation in local total pressure and any effect on local aspiration pressure. The results of these tests are shown in FIG. 8 for a plenum with a single 0.3 $in^2$ inlet and with a simulated 0.19 $in^2$ double inlet internal constrictor.

Local total pressure variations in the plenum change from nearly uniform with the single inlet to +/−10% of the mean plenum static pressure with the internal constrictor; thus, even with a uniform gas orifice, local gas mass flux and momentum flux would be expected to vary by +/−10% around the circumference of the nozzle. It was noted that the local aspiration effect was modest (less than +/−5%), the first of several measurements showed that the aspiration pressure (a parameter commonly used in atomization to characterize nozzle performance) was not a sensitive indicator of non-axisymmetric effects.

These results appear to solidify the proposition that the closer pure symmetric gas flows were approached the more detrimental to fine powder yield and that yields could be increased by the introduction of at least some non-axisymmetric effects.

Figure 9:
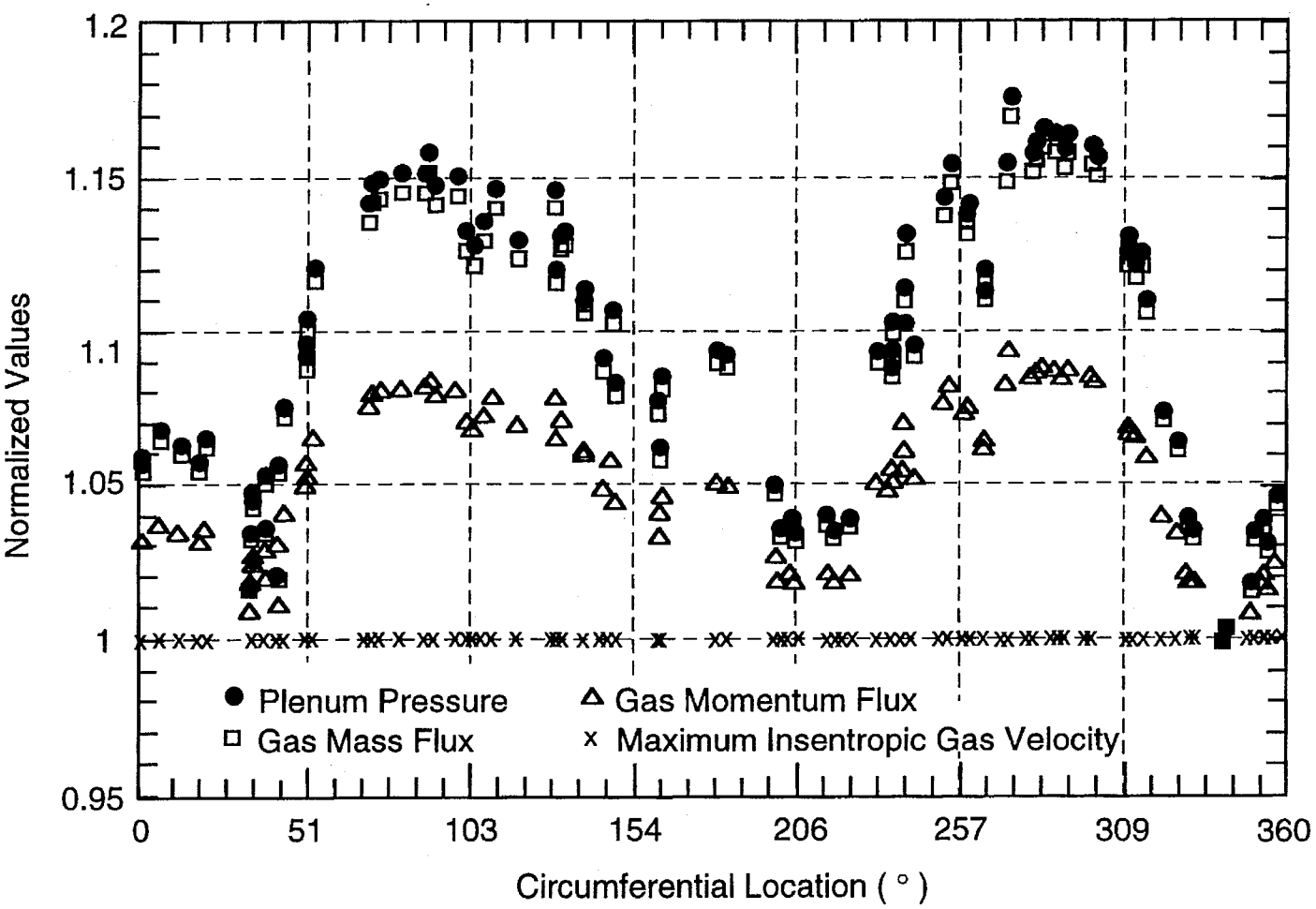
FIG. 9 is a graph showing the relationship between plenum pressure, gas mask flux, gas momentum flux, and maximum isentopic gas velocity.

One dimensional isentopic calculations of the gas flow can be used to draw some interesting conclusions about the effect of the circumferential pressure variation. Although the total pressure peak to peak fluctuation was about 15% (1.35 mPa), the maximum isentopic gas velocity is virtually unaffected while both the gas mass and gas momentum fluxes vary by 8 and 15% respectively, FIG. 9.

These calculations imply that atomization is affected by the overall gas flow field that develops as a result of the interaction between the non-axisymmetric components of the gas jets, and not by changes in velocity near the melt guide tube exit orifice tip. Therefore, it is presently believed that a circumferential variation in the gas orifice thickness which creates a circumferential variation in gas mass flow should lead to comparable results even with uniform plenum pressures.

Non-Axisymmetric gas flow has been shown to provide improved close-coupled atomization of nickel base superalloys. A means has been devised for introducing non-axisymmetric flow in otherwise axisymmetric plenums. An annular ring, containing two to four channels was inserted within the plenum. The channels result in local jetting of the atomization gas such that a non-axisymmetric flow field was established. It was determined that the degree of non-axisymmetric could be altered by changing the size of the channels.

Large Plenum Tests

Initial atomization tests of the large plenum like that shown in FIG. 4 revealed a significant loss in fine powder yield. These initial results were confirmed when the large plenum was mounted and tested in different atomization unit. Yields attained with the large plenum were determined to be about 7% to about 10% less than the historic yield curve for a small plenum like that shown in FIG. 3.

The physical differences between the two plenums are schematically illustrated in the figures. The physical differences may be summarized in that the large plenum had larger gas inlets and an increased plenum gas area volume compared to the small plenum volume (see table 1). These changes to the large plenum should have resulted in a more uniform gas flow as compared to the small plenum.

Initially, involvement with the large plenum focused on assessing whether the loss in performance was really plenum or atomization vessel related and what changes might be implemented in order to raise yield to an acceptable level. In order to provide this information, both water and melt atomization tests where conducted. The results of the melt atomization tests are reported below.

Melt atomization was conducted using the large plenum in several different configurations. In the first configuration, no constrictor was used. In the second configuration, a constrictor was inserted into the plenum to mimic the gas flow patterns generated in the smaller plenum. In these tests the gas inlet tubes and the constrictor inlets were at 45°. In the third configuration, the constrictor inlets were positioned in line with the plenum gas inlets (to minimize any swirl induced in the gas flow by use of the constrictor).

In all tests the melt guide tube (MGT) had a melt orifice diameter of about 4 mm (0.187 in.) and a conical external surface of about 12.5°. Differences between the tests at the two locations were the use of boron nitride (vs. zirconia) MGTs and ~250° C. superheats (vs. 10% to 75° C.).

A composite of the results of these tests is shown in FIG. 6 along with yield curves for the small and the large plenums. The first set of results for the large plenum (in the stock configuration) produced very low yields, less than 45%, that cleanly bracketed the yield curve previously determined.

Tests with the constrictor boosted yield to the level of the small plenum (see FIG. 6), confirming the observation of increased yields when utilizing the constrictor. Repositioning the constrictor inlets in line with the gas inlets further improved the atomization process such that yields obtained were consistent with previous yields.

High-speed video images of the tests were made with the large plenum, with the added constrictor 45° C. to gas inlets, and with the added constrictor in line with the gas inlets. Details that were observe in an overall picture of the plume and that can be related to increased yields of fine powder are: increased overall width or dispersion of the plume; decreased core structure of the plume and decreased length of visible plume.

Details that were observed in a close-up picture of the plume and that can be related to increased yields of fine powder are: reduced metal fragment size; increased surface irregularity of the liquid fragments; apparent increase in inter fragment distances and increased plume width.

It was determined that the relationship between the gas redistribution element, the gas plenum, and the gas delivery system, was such that the constrictor positioned in the large plenum prevented full and equitable distribution of the gas flow from the gas orifice. The effect of jetting of the gas as it exits the gas inlets into the plenum as in the small plenum is maintained to a certain degree as the gas passes through the plenum and exits the gas orifice to interact with a melt. In other words, there is a local and preferential flow from the gas orifice that is associated with the location of the gas delivery lines or special gas diverter/constrictor located within the plenum. The effect and magnitude of the circumferential variation in gas flow that can be produced is sufficiently large such that the gas flow field can be described as non-axisymmetric and the gas/metal flow field, or the atomization plume is measurably non-axisymmetric in the immediate vicinity of the gas nozzle From these experiments, it was concluded that: because of internal gas flow characteristics, the large plenum did in fact seriously impair expected atomization performance with variances (from the known database) ranging from −11% to −17%; use of the constrictor, 45° off axis, improved yields to that of the small plenum, or approximately a −5% variance; incorporation of the constrictor in line with the gas inlets further increased yields so that variances were within +/−1% of the known database; improved yield over the base plenum, but variances ranged from −5% to +1%. Review of the atomization videos revealed that the appearance of the atomization plume could be strongly correlated to the ultimate yield produced in any one experiment.

Use of the constrictor produced a water plume that was visibly non-axisymmetric within about two (2) tip diameters of the MGT tip. With the constrictor orthogonal to the gas inlet, a double lobe in the plume was very evident, with the constrictor in line, the double lobe was again present, but significantly less evident. With the constrictor at 45°, minor lobes were observed in the plume.

The orientation of the lobes was approximately 90° to the constrictor opening. It appeared as if the jetting due to the opening of the constrictor were spreading the plume laterally away from the center of the concentrated gas flow. The plenum, without the use of a constrictor produced an apparently axially symmetric plume. In all cases the constrictor produced plumes that were noticeably broader and more diffuse than the plume produced by the plenum alone.

Thus, it is clear from the above that the conventional wisdom relating to maintaining an axisymmetric gas flow in atomization systems was incorrect in that the closer pure symmetric gas flows were approached the more detrimental to fine powder yield and that yields could be increased by the introduction of at least some non-axisymmetric effects.

While the systems and methods disclosed herein constitute preferred embodiments of the invention, it is to be understood that the invention is not limited to these precise systems and methods, and that changes may be made therein without departing from the scope of the invention which is defined in the appended claims.

What is claimed is:

1. A close-coupled axisymmetric atomization system for atomizing molten metal comprising:

a close coupled nozzle including a plenum having a channel therein for delivering gas;

a melt guide tube extending axially through the plenum to an exit orifice, the plenum means including means for supporting the melt delivery tube; and constrictor means, operatively positioned in the plenum, for facilitating the interaction of the delivered gas with the molten melt at a point proximate the melt guide tube exit orifice such that the yield of fine powder was increased by about five (5) to about fifteen (15) percent over the yield achieved without the constrictor means.

2. Apparatus for atomizing liquid metal comprising:

a liquid metal supply;

a gas nozzle for atomizing a stream of liquid metal from the liquid metal supply in an atomization zone having a plume extending from the nozzle; and constrictor means, operatively positioned in a plenum, for facilitating the interaction of the gas with the liquid metal at a point proximate a melt guide tube exit orifice such that the yield of (–400 mesh) fine powder was increased by about five (5) to about fifteen (15) percent over the yield obtained without the constrictor means.

3. A system for the close-coupled atomization of liquid metal in an enclosure, the system comprising:

a crucible;

a gas nozzle operatively positioned in the enclosure;

a melt guide tube operatively connected to the crucible;

a plenum, operatively connected to the nozzle and operatively positioned relative the melt guide tube, for providing atomizing gas to the nozzle;

an atomization zone including a plume, existing when liquid metal is exiting the melt guide tube and gas is exiting the gas nozzle; and constrictor means, operatively positioned in the plenum, for facilitating the interaction of the gas with the liquid metal at a point proximate the melt guide tube exit orifice such that the yield of (–400 mesh) fine powder was increased by about five (5) to about fifteen (15) percent over the yield obtained without the constriction means.

4. A close coupled non-axisymmetric atomization system for atomizing molten metal comprising:

an axisymmetric plenum means having a channel therein for delivering fluid;

a melt guide tube extending axially through the plenum to an exit orifice, the plenum means including means for supporting the melt delivery tube; and means, operatively positioned in the plenum means, for facilitating the formation of a non-axisymmetric plume within about 5 melt guide tube effective diameters of the melt guide tube exit orifice, wherein the effective diameter is calculated by determining the area of the exit orifice and calculating the diameter of a circle having the same area as the exit orifice.

5. The system of claim 4 wherein the producing non-axisymmetric gas flow producing means further comprises:

a constrictor.

6. A close coupled non-axisymmetric atomization system for atomizing molten metal comprising:

plenum means having a channel therein for delivering fluid;

a melt guide :tube extending axially through the plenum to an exit orifice, the plenum means including means for supporting the melt delivery tube; and means, operatively positioned in the plenum means, for facilitating the formation of a non-axisymmetric plume within about 5 melt guide tube effective diameters of the melt guide tube exit orifice, wherein the effective diameter is calculated by determining the area of the exit orifice and calculating the diameter of a circle having the same area as the exit orifice.

7. A gas plenum useful for the atomization of molten metals comprising:

an outer casing for containing a gas;

a gas orifice; and means for limiting the redistribution of the gas within the plenum such that local circumferential variations in the gas exiting the orifice cause the mass flux to vary by more than about ten (10) percent and the momentum flux to vary by more than about five (5) percent, as calculated by making isentropic assumptions about the flow around the perimeter of the gas exit using the measured pressure variations of more than about ten (10) percent within the plenum.

8. The plenum of claim 7 wherein the gas redistribution limiting means further comprises:

a constrictor, operatively positioned inside the outer casing.

* * * * *